United States Patent [19]

McCullough et al.

[11] Patent Number: 4,631,118

[45] Date of Patent: Dec. 23, 1986

[54] LOW RESISTANCE COLLECTOR FRAME FOR ELECTROCONDUCTIVE ORGANIC, CARBON AND GRAPHITIC MATERIALS

[75] Inventors: Francis P. McCullough, Lake Jackson; Roy V. Snelgrove, Freeport, both of Tex.

[73] Assignee: The Dow Chemical Company, Midland, Mich.

[21] Appl. No.: 729,702

[22] Filed: May 2, 1985

[51] Int. Cl.[4] ..... C25D 5/48

[52] U.S. Cl. ..... 204/16; 204/38.5; 204/38.7

[58] Field of Search ..... 204/16, 38.3, 38.5, 204/38.7

[56] References Cited

U.S. PATENT DOCUMENTS 4,401,519 8/1983 Kadija ..... 204/16

4,421,609 12/1983 Gerard ..... 204/16

*Primary Examiner*—T. M. Tufariello

[57] ABSTRACT

A low resistance electrical connection is disclosed to connect two dissimilar electroconductive materials, one of which is a fiber, bundle of fibers or a film of an electroconductive polymer, carbon or graphite to an electroconductive metal collector. The connection is achieved by electroplating at an initial low current density the edge ends of a fiber or bundle of fibers or the edges of a cloth or film with an electroconductive metal, e.g. copper, silver and the like; thereafter crimping a fine electroconductive wire mesh onto said plated area and then continuing the said plating process until the wire mesh or gauze is substantially encapsulated with said electroplated metal. Alternative, the electroplated fiber ends may be joined by solder, as by dipping the ends or edges into a molten solder bath or laying a bead of solder substantially onto the copper plated edge of the fiber, bundle, cloth or film. Such practice ensures the electroconductive polymer, carbon or graphite end or edge will be intimately bound to the electroconductive metal forming the collector or frame.

In many instances it is necessary that the collector metal and/or frame be insulated both electrically and chemically from contact with the environment into which the electroconductive polymer, graphite, carbon and the like is to be used. A procedure is described for protecting the collector frame when placed in hostile environment service.

24 Claims, 1 Drawing Figure

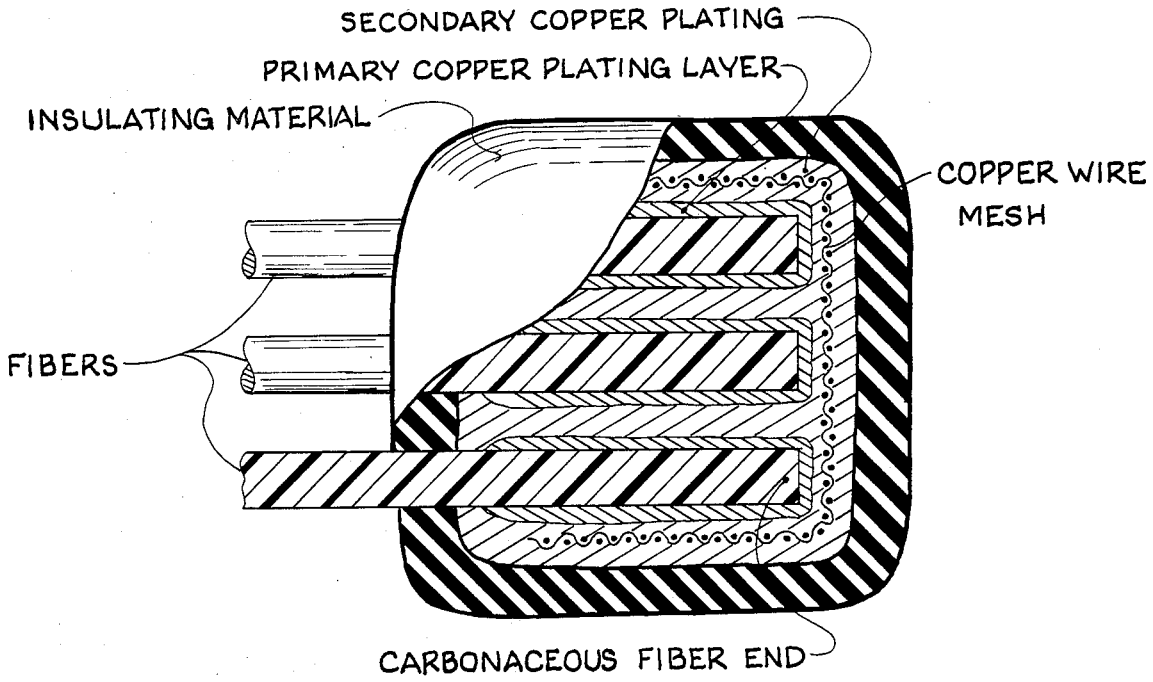
SECONDARY COPPER PLATING
PRIMARY COPPER PLATING LAYER
INSULATING MATERIAL
COPPER WIRE MESH
FIBERS
CARBONACEOUS FIBER END

LOW RESISTANCE COLLECTOR FRAME FOR ELECTROCONDUCTIVE ORGANIC, CARBON AND GRAPHITIC MATERIALS

BACKGROUND OF THE INVENTION

Industry has problems making good low resistance electrical connections between electroconductive metals and electroconductive polymeric materials, carbon and graphite. Present day practice employs one of several techniques. One technique is to crimp or clamp an electroconductive metal clip to the material which may have been coated with a conductive material such as solder or metalized paint, relying on pressure to make the contact either directly to the material per se or to the solder or painted area. Another technique widely practiced is to first coat the polymeric material, graphite or carbon with a thin film of solder or electroconductive paint (i.e. silver dispersed in an epoxy resin) folowed by electroplating the solder or painted area. Such techniques do not produce the lowest possible electrical resistance. Further, such techniques require the metal contact to remain out of contact with the electrolyte or that a noble metal be used which will not dissolve in the electrolyte under use conditions.

In light of the interest in using electroconductive polymeric materials, carbon and graphite in the form of fibers, bundles of fibers, cloth and films in batteries, fuel cells, electrochemical cells, electrochemical reactions and the like, it appears essential that the lowest possible resistance connections be made between the carbon/-graphite or electroconductive polymeric material and the metal collector, wires, etc.

BRIEF DESCRIPTION OF THE INVENTION

In accordance with the present invention a low resistance electrical connection can be prepared between an electroconductive material (carbon, graphite and polymeric material such as heat treated polyacrylonitrile, polyacetylene and the like) and an electroconductive metal by low current density electroplating the edges of cloth or film of the material or individual fiber ends or bundles of fiber ends with electroconductive metal or electroless deposition by chemical reduction of a metal or its salt at the surface of the material than either (a) (1) crimping a fine electroconductive metal wire mesh or gauze (e.g. 40–100 mesh) to the electroplated area followed by continuing the plating process until the mesh or gauze is embedded in an electroplated film or (2) applying a solder coat onto and over said mesh embedding said mesh in said solder, or (b) applying a solder bead on or solder coating onto said copper plated edge, as by dipping in molten solder, the plated area of the material. Finally, since in most end uses it is desirable to have the collector metal insulated against both electrical contact with and/or chemical attack by the use environment, the collector metal is encapsulated in an electrical insulating material such as a cured polyester-epoxy resin, rubber or other resinuous material by dipping or painting or by cathodic electrodeposition or the metal maybe coated with an oxide or oxidizable metal or the metal per se oxidized, all of which will withstand chemical attack by the use environment. The encapsulation should preferably also encapsulate the fiber, or the like exposed at the collectors edge.

The above technique is applicable to a wide variety of electroconductive materials. For example, various forms and grades of carbon and graphite particularily graphite fibers, formed from coal tar or petroleum pitches which are heat treated to graphitize to some degree the carbonaceous matter. In addition the various polymers which on heating to above about 800° C.–850° C. lose their noncarbon or substantially lose their noncarbon elements yielding a graphite like material (a material having substantial polyaromatic configurations or conjugated double bond structures) which results in the structure becoming electroconductive. For example acrylonitrile fibers, bundles of fibers, halogenated polyethylenes, polyethylenes and the like fibers, bundles of fibers and/or sheets when heated to above 800° C. become electroconductive and appear to be in part at least graphitic in form.

While many techniques are used to make electrical connections to carbon vis-a-vis graphite most are pressure point contacts. The present invention would be applicable to making and lower resistance electrical connections to these forms of carbon.

Encapsulating materials include cured forms of the epoxy resins, the copolymer epoxy resins (polyester epoxy), the fluorinated polymers and copolymers polyvinyl and vinylidene chloride which may be applied by dipping, painting, applying heat shrinkable or meltable films cathodic electrodeposition, the plastic metal techniques such as acrylic/plastic to metal and or laminate techniques or the like. The nature and properties of use dictating the necessary physical and chemical properties of the encapsulating resins.

It is to be further understood that encapsulation maybe dispensed with if the conductive metal or a coating of metal applied is oxidizable or fluorinatable to produce a non-conductive coating or surface which is also non-reactive under the conditions or use.

IN THE DRAWING

The drawing illustrates in partial cross section the encapsulated, copper plated fiber ends of the electrode component of the present invention.

DETAILED DESCRIPTION OF THE INVENTION

In accordance with the present invention two electrodes were prepared from rectangular pieces of cloth prepared from acrylonitrile yarns made up of fibers, spun and formed into threads and yarns, woven and then heated to above 850° C. to make them electroconductive and substantially graphitic in character, and thereafter the piece of cloth electroplated on each of its four sides. The electroplating was carried out in a low current density, 30–150 milliamps per square inch of geometric area of the cloth immersed in the bath, about ¼ to ½ inch of each side. The bath was a commercial acidic copper sulfate solution and the anode was a copper metal bar. The plating was done slowly to insure the metal coated each fiber end. Plating time was from 2–3 hours per edge. Energy dispersion Xray using a microprobe (EDX) showed that the copper had coated substantially each fiber end of each bundle Thus there was obtained a good electrical contact with each fiber.

One of the edge electroplated pieces had a fine (100 mesh) copper gauze about ½ inch wide folded in half and lightly crimped onto each edge to form a continuous ¼ mesh rim about the edges of the cloth. Thereafter, electroplating was continued until the copper mesh was substantially encapsulated within the added electroplate and intimately joined to each previously plated fiber bundle.

The cloth then had a copper wire soldered to one corner of the electroplated edge. Each edge of the cloths copper plate rim was imbedded in a polyester-epoxy resin (Derakane) to a depth to cover all the electroplate and the wire connection and the abutting portion of the fibers.

Another set of electrodes were prepared in the same manner except rather than using wire connecter the screen was extended at one edge to form a connector. Such technique strengthens the electrical connection through the insulating encapsulation.

In an experiment to determine the relative resistance of several types of common connection techniques five equal strips of woven cloth obtained from the manufacturer in a stabilized form sold under the tradename Thornel VCB 45 by heat/oxidation and made electroconductive by further heat treatment above 800° C. by the manufacturer were copper plated on one end, a fine wire mesh gauze folded and crimped over the copper plate and the copper plating continued until the gauze was embedded in copper. The other end of each strip was prepared as follows:

Strip 1 electroplated as above described;

Strip 2 painted with a copper paint (Copper Dip It conductor coating), a fine wire mesh crimped over the paint and the mesh repainted;

Strip 3 an indium foil was crimped over the end and held in place by two copper plates, one on each side clamped between a "Swingline" binder clip;

Strip 4 was painted with a commercial high purity silver paint used for scanning electron microscopes and a fine wire copper mesh crimped over the paint and the gauge repainted;

Strip 5 had a fine mwsh nickel screen crimped over the end and held in place with a "Swingline" binder clip.

A short wire was attached to each end of the metal coats, with an alligator clip. Strip 3 (the two with metal plates holding the Indium foil) and Strip 5 (the nickel screen) had the clips attached to the foil and screen respectively.

The relative resistance of each strip was measured

Relative Ohmic Resistance at 10 mA & 50 mA Current Thru Test Electrodes

| Strip | $R_{10}$ | $R_{50}$ |
|---|---|---|
| 1 | 1.00 | 1.00 |
| 2 | 2.72 | 3.20 |
| 3 | 1.29 | 1.46 |
| 4 | 1.25 | 1.25 |
| 5 | 2.70 | 3.26 |

What is claimed is:

1. A method for producing a low resistance electrical connection onto an electroconductive material selected from the group consisting of electroconductive polymeric organic materials, carbon and graphite which consists of (1) electroplating the area of desired electrical contact with an electroconductive metal;

(2) joining said so plated area into a continuous electroconductive path by crimping a fine wire mesh or gauze of electroconductive metal onto said electroplated area and at least the abutting electroconductive material; and thereafter bonding and coating said mesh/gauze to said plated area by subjecting said area to a treatment selected from the group consisting of (i) continuing said plating to bond said mesh to said plated area; (ii) applying a solder coat onto and over said mesh embedding said mesh in said solder; or (iii) applying a solder bead onto said electroplated area securing said mesh/gauze to said electroplated area;

(3) connecting an electrical current carrying conductor to said metal area;

(4) coating said metal area and at least a portion of any electrical current carrying conductor attached thereto and the electroconductive material immediately adjacent to said metal area by subjecting said area to a treatment selected from the group consisting of (a) coating with (i) a polymeric organic non-conductive material, (ii) a cathodic electrodepositable polymeric material, (b) applying an (i) oxidizable metal thereto and oxidizing the same (ii) fluoridizable metal thereto and fluoridating the same, or (c) oxidizing or fluorinating said metal surface per se.

2. The method of claim 1 wherein said electroplatable metal is copper.

3. The method of claim 1 wherein said electroplatable metal is copper and the mesh or gauze is copper.

4. The method of claim 1 wherein said electroplatable metal is copper, the mesh or gauze is copper and the gauze or mesh is copper plated.

5. The method of claim 1 wherein said plated area is coated with a polyester-epoxy resin.

6. The method of claim 1 wherein said metal is coated with an oxidizable metal and oxidizing the coat.

7. A method for producing a low resistance electrode collector frame onto an electroconductive material selected from the group consisting of polymeric organic materials, carbon and graphite which consists of (1) electroplating the area of desired electrical contact with an electroconductive metal;

(2) joining said so plated area into a continuous electroconductive path by crimping a fine wire mesh or gauze of electroconductive metal onto said electroplated area and at least the abutting the electroconductive material; and thereafter bonding and coating said mesh/gauze to said plated area by subjecting said area to a treatment selected from the group consisting of (i) continuing said plating to bond said mesh to said plated area, (ii) applying a solder coat onto and over said mesh embedding said mesh in said solder or (iii) applying a solder bead onto said electroplated area securing said mesh/gauze to said electroplated area;

(3) connecting an electrical current carrying conductor to said metal area;

(4) coating said metal area and at least a portion of any electrical current carrying conductor attached thereto and the electroconductive material immediately adjacent to said area by subjecting said area to a treatment selected from the group consisting of (a) coating with (i) a polymeric organic non-conductive material, (ii) a cathodic electrodepositable polymeric material, (b) applying an (i) oxidizable metal thereto and oxidizing the same, (ii) fluoridizable metal thereto and fluoridating the same, or (c) oxidizing or fluorinating said metal surfasce per se.

8. The method of claim 7 wherein said electroplatable metal is copper.

9. The method of claim 7 wherein said electroplatable metal is copper and the mesh or gauze is copper.

10. The method of claim 7 wherein said electroplatable metal is copper, the mesh or gauze is copper and the gauze or mesh is copper plated.

11. The method of claim 7 wherein said plated area is coated with a polyester-epoxy resin.

12. The method of claim 7 wherein said metal is coated with an oxidizable metal and oxidizing the coat.

13. A method for producing a low resistance electrode assembly consisting of an electroconductive material selected from the group consisting of polymeric organic materials, carbon and graphite which consists of (1) electroplating the area of desired electrical contact with an electroconductive metal;

(2) joining said so plated area into a continuous electroconductive path by crimping a fine wire mesh or gauze of electroconductive metal onto said electroplated area and at least the abutting electroconductive material; and thereafter bonding and coating said mesh/gauze to said plated area by subjecting said area to a treatment selected from the group consisting of (i) continuing said plating to bond said mesh to said plated area: (ii) applying a solder coat onto and over said mesh embedding said mesh in said solder; or (iii) applying a solder bead onto said electroplated area securing said mesh/gauze to said electroplated area;

(3) connecting an electrical current carrying conductor to said metal area;

(4) coating said metal area and at least a portion of any electrical current carrying conductor attached thereto and the electroconductive material immediately adjacent to said metal area by subjecting said area to a treatment selected from the group consisting of (a) coating with (i) a polymeric organic non-conductive material.

(ii) a cathodic electrodepositable polymeric material, (b) applying an (i) oxidizable metal thereto and oxidizing the same, (ii) fluoridizable metal thereto and fluoridating the same, (c) oxidizing or fluorinating said metal surface per se.

14. The method of claim 13 wherein said electroplatable metal is copper.

15. The method of claim 13 wherein said electroplatable metal is copper and the mesh or gauze is copper.

16. The method of claim 13 wherein said electroplatable metal is copper, the mesh or gauze is copper and the gauze or mesh is copper plated.

17. The method of claim 13 wherein said plated area is coated with a polyester-epoxy resin.

18. The method of claim 13 wherein said metal is coated with an oxidizable metal and oxidizing the coat.

19. A method for producing an electrode for a non-aqueous battery which electrode has a low resistance electrical connection to an electroconductive material selected from the group consisting of polymeric organic materials, carbon and graphite which consists of (1) electroplating the area of desired electrical contact with an electroconductive metal;

(2) joining said so plated area into a continuous electroconductive path by crimping a fine wire mesh or gauze of electroconductive metal onto said electroplated area and at least the abutting electroconductive material; and thereafter bonding and coating said mesh/gauze to said plated area by subjecting said area to a treatment selected from the group consisting of (i) continuing said plating to bond said mesh to said plated area; (ii) applying a solder coat onto and over said mesh embedding said mesh in said solder; or (iii) applying a solder bead onto said electroplated area securing said mesh/gauze to said electroplated area;

(3) connecting an electrical current carrying conductor to said metal area;

(4) coating said metal area and at least a portion of any electrical current carrying conductor attached thereto and the electroconductive material immediately adjacent to said metal area by subjecting said area to a treatment selected from the group consisting of (a) coating with (i) a polymeric organic non-conductive material, (ii) a cathodic electrodepositable polymeric material, (b) applying an (i) oxidizable metal thereto and oxidizing the same, (ii) fluoridizable metal thereto and fluoridating the same, (c) oxidizing or fluorinating said metal surface per se.

20. The method of claim 19 wherein said electroplatable metal is copper.

21. The method of claim 19 wherein said electroplatable metal is copper and the mesh or gauze is copper.

22. The method of claim 19 wherein said electroplatable metal is copper, the mesh or guaze is copper and the gauze or mesh is copper plated.

23. The method of claim 19 wherein said plated area is coated with a polyester-epoxy resin.

24. The method of claim 19 wherein said metal is coated with an oxidizable metal and oxidizing the coat.

* * * * *